United States Patent [19]

Zeiset

[11] Patent Number: 4,673,061

[45] Date of Patent: Jun. 16, 1987

[54] AUTOMATIC LADDER LEVELING APPARATUS

[76] Inventor: A. Leon Zeiset, 270 Kriner Rd., Chambersburg, Pa. 17201

[21] Appl. No.: 896,045

[22] Filed: Aug. 13, 1986

[51] Int. Cl.[4] ..... E06C 7/44

[52] U.S. Cl. ..... 182/202; 248/188.3

[58] Field of Search ..... 182/200, 201, 202, 203, 182/204, 19; 248/188, 188.2, 188.3, 188.8

[56] References Cited

U.S. PATENT DOCUMENTS

| | | | |
|---|---|---|---|
| 2,330,825 | 10/1943 | Hoit | 228/63 |
| 2,366,829 | 1/1945 | Biery | 228/63 |
| 2,890,824 | 6/1959 | Derby et al. | 228/63 |
| 2,969,126 | 1/1961 | Gardner | 182/202 |
| 3,173,512 | 3/1965 | Sturdy et al. | 182/202 |
| 3,233,702 | 2/1966 | Feltrop | 182/202 |
| 3,258,085 | 6/1966 | McCarty | 182/202 |
| 3,260,329 | 7/1966 | Zevely | 182/202 |
| 3,794,141 | 2/1974 | Sturm | 182/202 |
| 4,497,390 | 2/1985 | Wilson | 182/202 |

*Primary Examiner*—Reinaldo P. Machado
*Attorney, Agent, or Firm*—Michael R. Swartz; John R. Flanagan

[57] ABSTRACT

An automatic ladder leveling apparatus includes a pair of extension members and a relatively stiff, cable-like semi-flexible elongated member. Each extension member is disposed adjacent to one side rail of the ladder for slidable movement equally freely in either direction therealong. The semi-flexible elongated member has a middle portion which makes only one pass across the ladder between its side rails. The middle portion of the elongated member extends through the lowest rung of the ladder. Opposite end portions of the elongated member extend in opposite directions from its middle portion and along the side rails of the ladder above its one lower rung where they attach to the respective extension members at locations between their opposite ends thereof. A block is disposed in the lowest rung of the ladder and has a portion between the middle portion of the elongated member and an upper portion of the rung. The block has surface portions and opposite corners which frictionally engage and crimp the middle portion of the elongated member when the weight of a user is applied to the ladder so as to substantially prevent slippage of the elongated member with respect thereto once the extension members have been placed in contact with a support surface and slidably self-adjusted along the side rails of the ladder for positioning and supporting the ladder in a generally leveled upright condition.

16 Claims, 8 Drawing Figures

AUTOMATIC LADDER LEVELING APPARATUS

BACKGROUND OF THE INVENTION

1. Field of the Invention

The present invention relates generally to ladders and, more particularly, is concerned with a leveling apparatus for adjusting the lengths of opposite side rails of a ladder to compensate for the unevenness of the surface upon which the ladder is placed so that the ladder can be maintained in a substantially level, upright position.

2. Description of the Prior Art

Oftentimes it is necessary to use a ladder in locations where the ground on which to support the ladder is uneven or sloping. The user will usually have to dig a shallow hole in order to level the ladder; otherwise, a dangerous lateral tilt is imparted to the ladder which ordinarily renders it unsafe to use. However, on some surfaces, such as roofs, steps and sloping sidewalks, such leveling measures cannot be applied.

Over the years, various ladder leveling devices have been proposed in the prior art to compensate for surface incline and unevenness. Representative of the prior art are the devices disclosed in U.S. Pat. Nos. to Hoit (2,330,825), Biery (2,366,829), Derby et al (2,890,824), Sturdy et al (3,173,512), McCarty (3,258,085), Zevely (3,260,329), Sturm (3,794,141) and Wilson (4,497,390). While many of these devices would appear to operate reasonably well and generally achieve their objectives under the range of operating conditions for which they were designed, most seem to embody shortcomings which make them less than an optimum ladder leveling device. Some leveling devices are complicated and expensive to manufacture, while other devices are awkward to use and not completely reliable in operation.

Consequently, a need still exists for a ladder leveling mechanism which is self-adjusting, easy to use, simple in construction and operation, and reliable.

SUMMARY OF THE INVENTION

The present invention provides an automatic ladder leveling apparatus designed to satisfy the aforementioned needs. The hallmark of the ladder leveling apparatus of the present invention is the simplicity of its construction and operation, whereas a common feature of the prior art devices is their complexity, such as exemplified in the device of the McCarty patent. The ladder leveling apparatus of the invention is composed of many fewer parts than the McCarty device which inherently increases the reliability and ease of operation of the apparatus. Also, unlike the McCarty device which has leg extensions spring-loaded in the upward direction, the extension members of the present invention are slidable equally freely in either direction which allows easier self-adjustment by merely placing the ladder on the supporting surface at the desired location where it will be used. In addition, the leveling apparatus of the present invention employs a pair of extension members interconnected intermediate their opposite ends by opposite end portions of a relatively stiff, cable-like semi-flexible elongated member and freely slidable vertically up and down within brackets on the side rails of the ladder. A middle portion of the semi-flexible elongated member passes only once across the ladder through a bottom rung thereof which gives the effect of the ladder hanging or suspended in a sling. In contrast thereto, the McCarty device employs a flexible tie in the form of a cable, chain or rope which makes several passes across the ladder along the lower rung in being looped several times about blocks in the rung. The flexible tie is secured near the upper ends of the extensions and drawn taut by the tension of springs until the tie loops frictionally grip the blocks in the lower rung. In the present invention, when weight is applied to the ladder, that causes the semi-flexible elongated member to be somewhat crimped into the corners of a block or slab of material placed in the bottom rung of the ladder so as to prevent slippage of the semi-flexible elongated member relative to the ladder. No loops of the elongated member about the material in the bottom rung nor springs to hold it taut are necessary. Unlike the flexible tie of McCarty which can fold back upon itself if not maintained in a taut condition during adjustment of the positions of the leg extensions, the semi-flexible elongated member used in the apparatus of the present invention cannot fold back on itself because of its stiffness and because the channel space in the lower rung and the extension members through which the elongated member extends is too narrow to permit the elongated member to do so.

Accordingly, the present invention is provided in combination with a ladder having a pair of longitudinally-extending side rails being transversely spaced apart from one another by a series of rungs extending between and interconnecting the side rails and being longitudinally-spaced apart from one another along the side rails. The ladder leveling apparatus of the present invention includes: (a) a pair of extension members each being disposed adjacent to one of the side rails for slidable movement equally freely in either direction therealong and having opposite ends, one of the opposite ends being disposed along the corresponding side rail and the other of the opposite ends being disposable adjacent a surface on which the ladder will be supported; (b) a relatively stiff, cable-like semi-flexible elongated member having a middle portion which extends only once across the ladder along a lower one of the ladder rungs and below a portion thereof and opposite end portions which extend in opposite directions from the middle portion and are located along the side rails of the ladder above the one lower rung and attached to the respective extension members at locations between the opposite ends thereof; and (c) means associated with the one lower rung of the ladder between the middle portion of the elongated member and the portion of the one lower rung, the means defining at least one surface which frictionally engages and crimps the middle portion of the elongated member when the weight of a user is applied to the ladder so as to substantially prevent slippage of the elongated member with respect thereto once the extension members have been placed in contact with the surface and slidably moved along the side rails of the ladder for positioning and supporting the ladder in a generally leveled upright condition.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 2:
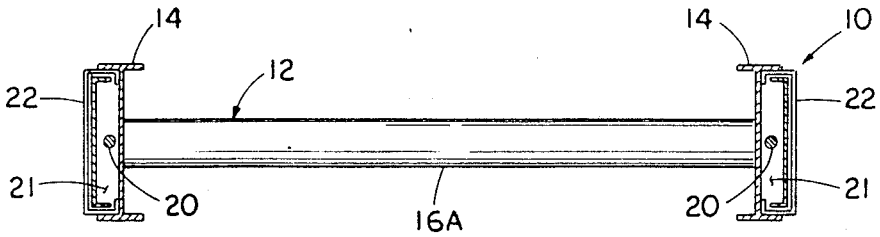
FIG. 2 is a transverse sectional view of the ladder and leveling apparatus taken along line 2—2 of FIG. 1.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Figure 1:
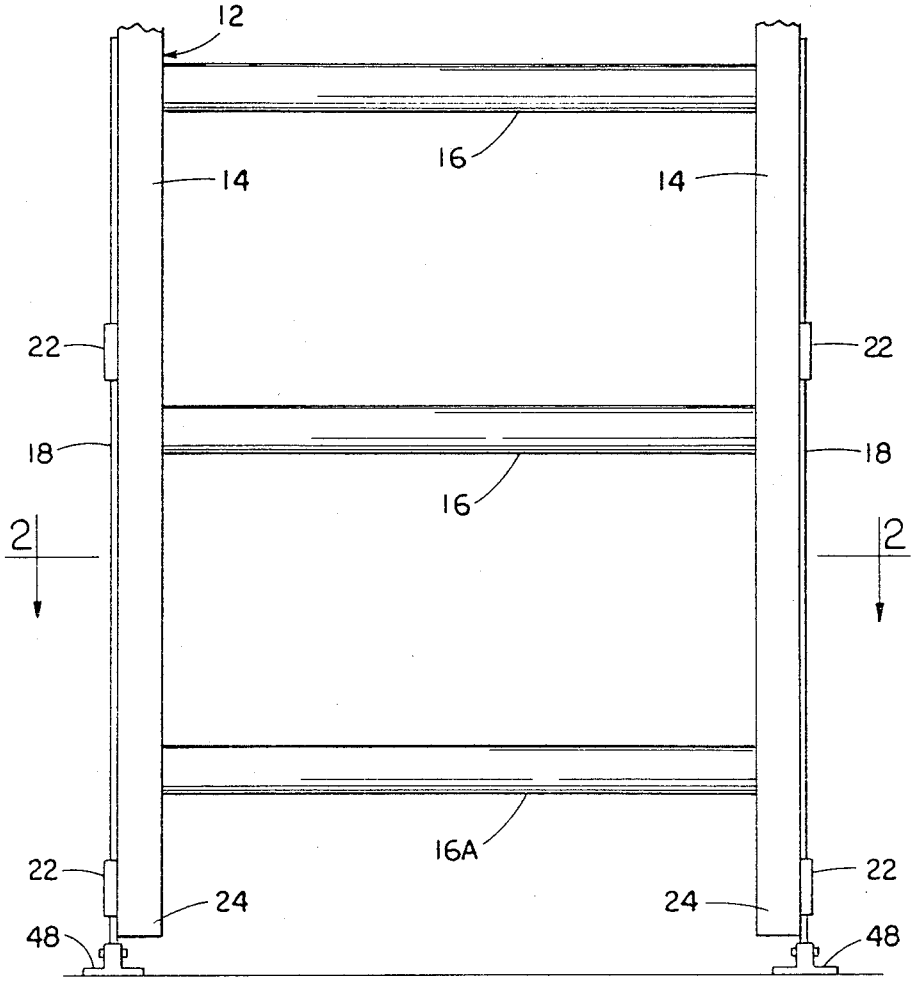
FIG. 1 is a front elevational view of the lower portion of a ladder employing the ladder leveling apparatus of the present invention.
Figure 4:
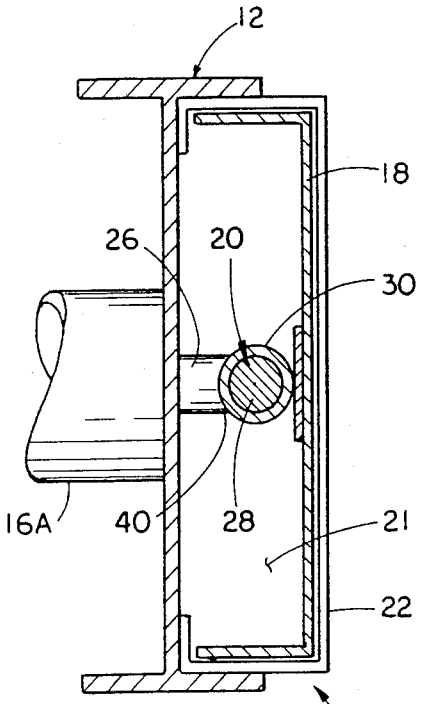
FIG. 4 is a cross-sectional view of the right side rail of the ladder and the stiff semi-flexible elongated member and right extension member of the leveling apparatus taken along line 4—4 of FIG. 3.
Figure 5:
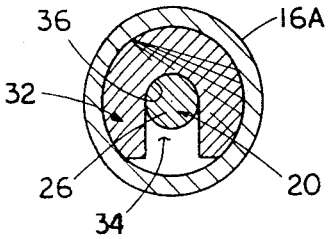
FIG. 5 is a cross-sectional view of bottom rung of the ladder and the slab of material and the semi-flexible elongated member of the leveling apparatus taken along line 5—5 of FIG. 3.

Referring now to the drawings, and particularly to FIG. 1, there is shown the preferred embodiment of the automatic ladder leveling apparatus of the present invention, being indicated generally by the numeral 10, applied to an otherwise conventional ladder 12. The ladder 12 has a pair of longitudinally-extending side rails 14, for example, each having an I-beam cross-sectional configuration as shown in FIGS. 2 and 4. The side rails 14 are transversely spaced apart from one another by a series of steps or rungs 16, for example, each having a hollow tubular cross-sectional configuration as shown in FIG. 5. The rungs 16 extend between and interconnect the side rails 14 and are longitudinally-spaced apart from one another along the side rails in a conventional manner. In an exemplary embodiment, the ladder 12 is composed of aluminum material, although other suitable materials can be used.

The automatic ladder leveling apparatus 10 includes a pair of elongated extension members 18 and a relatively stiff, cable-like semi-flexible elongated member 20. Each extension member can be composed of aluminum material, although other suitable materials can be used. The semi-flexible elongated member 20 is longitudinally inflexible and relatively stiff when bending it so as to be generally incapable of being easily bent back upon itself. It is thereby characterized as partially bendable or semi-flexible as opposed to an ordinary cable, fiber rope or chain which is readily flexible and bendable upon itself. In an exemplary embodiment, the elongated member 20 can be a cable-like material such as wire rope which is a flexible, multi-wire stranded structure. In the preferred embodiment, the specific elongated member used is ½ inch diameter aircraft cable. There are various types of wire ropes having a multitude of properties and reference should be made to the Roebling Wire Rope Handbook by the Colorado Fuel And Iron Corporation for a more complete understanding thereof.

Each of the elongated extension members 18 has a generally U-shaped cross-sectional configuration, as shown in FIGS. 2 and 4, which is dimensioned to partially fit within a channel 21 defined on the outer side of each one of the respective I-beam shaped side rails 14. A pair of vertically spaced, generally U-shaped brackets 22 are fixedly attached to the outer side of each of the side rails 14. A lower one of the brackets 22 is disposed adjacent to and spaced a short distance above the lower terminal end 24 of the respective side rail 14. On the other hand, the upper one of the brackets 22 is disposed just above the second rung 16 of the ladder 12 up from the bottom which is just over half of the length of the extension member 18 up from its lower end when it is substantially fully retracted within the side rail 14, as seen in FIG. 1. Each extension member 18 is disposed along and extends partially within the channel 21 of the respective one side rail 14 of the ladder 12 and is retained in such position and guided along the channel by the pair of spaced brackets 22 which encompass the extension member 18 at its outer side, as shown in FIGS. 2 and 4. In such positional relationship, each extension member 18 is slidably movable equally freely in either direction along the side rail 14. There are no springs connected to it to bias it upwardly or downwardly along the side rails 14. In a sense the extension members 18 are free floating, only being interconnected by the semi-flexible elongated member 20.

Figure 6:
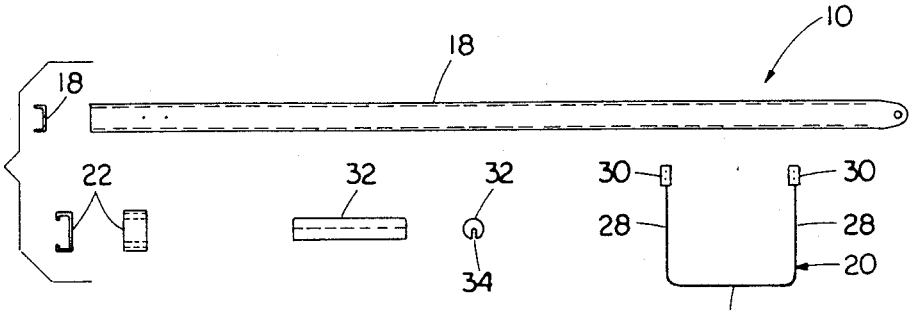
FIG. 6 is an exploded view of the parts of the ladder leveling apparatus.

The semi-flexible elongated member 20 has a middle portion 26 and a pair of opposite end portions 28 extending from opposite ends of the middle portion. The semi-flexible elongated member 20 generally takes on a U-shaped configuration, as best seen in FIG. 6 and also in FIGS. 7 and 8. The bight of the U is the middle portion 26 which extends only once or makes only one pass across the ladder 12 between its side rails 14, whereas the end portions 28 of the member 20 are the upright legs of the U. More particularly, the middle portion 26 of the semi-flexible elongated member 20 extends along the lowest one of the ladder rungs 16A, whereas the opposite end portions 28 of the semi-flexible elongated member 20 extend from the middle portion upwardly along the side rails 14 of the ladder 12 above the lowest rung 16A. They extend within the channels 21 between the side rails 14 and the extension members 18 to connectors 30 on their terminal ends where they attach to the respective extension members 18 at locations between opposite ends thereof, but significantly nearer to the upper than the lower ends of the extension members 18.

Figure 3:
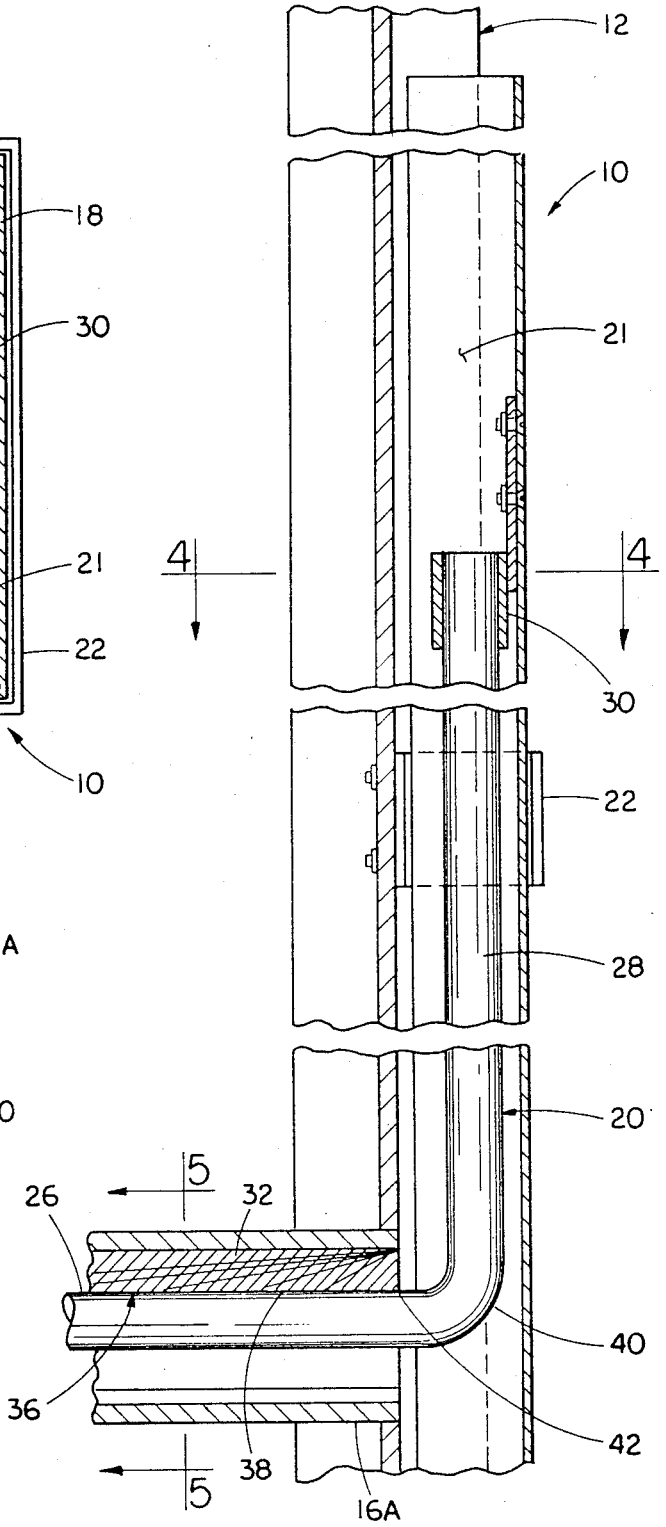
FIG. 3 is an enlarged fragmentary longitudinal sectional view of the ladder and leveling apparatus at the corner formed by the right end of the bottom rung and the right side rail as seen in FIG. 1.

As seen in FIGS. 3, 5 and 6, a block 32, for instance composed of wood although other suitable materials can be used, is disposed within the lowest rung 16A of the ladder 12 between the middle portion 26 of the semi-flexible elongated member 20 and the upper portion of the rung. The block 32 is generally cylindrical in cross-section, as seen in FIG. 5, and dimensioned to snugly fit within the hollow cylindrical interior of the lowest rung 16A. An elongated generally axially extending groove 34 open along its bottom is formed in the block 32 and defines a surface 36 whose portions 38 primarily located at the opposite end portions of the block 32 frictionally engage the middle portion 26 of the semi-flexible elongated member 20 rather tightly when the weight of a user is applied to the ladder 12. The bends 40 in the semi-flexible elongated member 20 are located generally at the opposite ends of the block 32 where the member 20 tends to be crimped by the corners 42 of the block 32.

Figure 7:
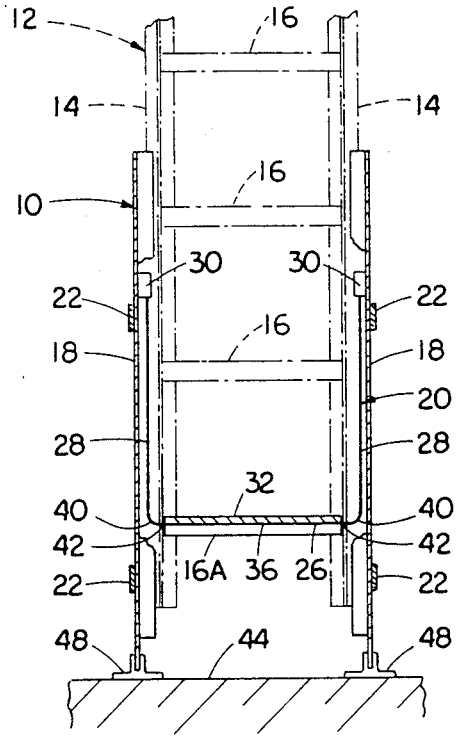
FIG. 7 is a diagrammatic view of the relative positions of the extension members and the semi-flexible elongated member of the ladder leveling apparatus when the ladder is supported on a generally level surface.
Figure 8:
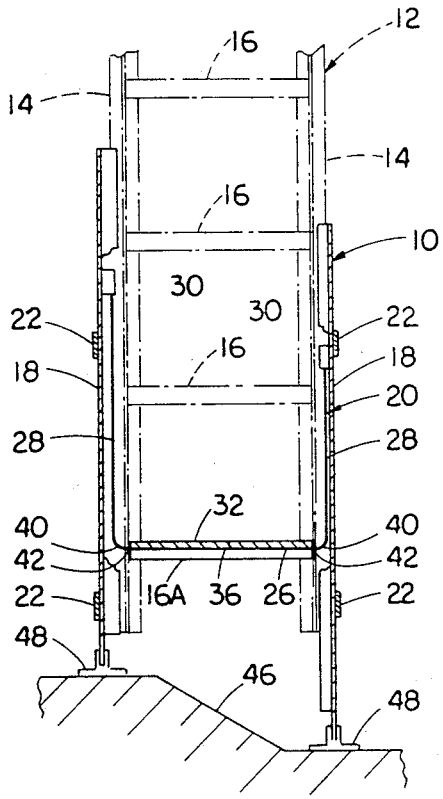
FIG. 8 is another diagrammatic view of the relative positions of the extension members and the semi-flexible elongated member of the ladder leveling apparatus when the ladder is supported on a stepped surface.

Even though only a single pass of the semi-flexible elongated member 20 extends through the lowest rung 16A, the frictionally engaged and crimped relationship between the block 32 and member 20 when weight is placed on the ladder 12 is enough to substantially prevent any slippage of the semi-flexible elongated member 20 with respect thereto once the extension members 18 have been placed in contact with a support surface and slidably moved within the channels 21 and along the side rails 14 of the ladder 12 to position and support the ladder in a generally leveled upright condition, for instance as seen in both FIGS. 7 and 8. The extension members 18 will automatically self-adjust along their respective side rails 14 as the user lifts and moves the ladder 12, for instance from the level surface 44 of FIG. 7 to the inclined stepped one 46 of FIG. 8. Each of the extension members 18 has a generally planar foot plate 48 pivotally mounted about a horizontal axis to its lower end for supporting the respective member on the surfaces 44,46. As seen in FIGS. 7 and 8 and described above, the semi-flexible elongated member 20 passes only once in a non-looping manner at its middle portion 26 across the ladder 12 through the lowest rung 16A thereof. In view of this relationship in combination with attachment at its end portions 28 to the extension members 18, the U-shaped semi-flexible elongated member 20 in effect acts like a sling suspending the ladder 12 thereabove with upright legs of variable lengths being confined within the channels 21 between the side rails 14 and extension members 18.

It is thought that the automatic ladder leveling apparatus of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. In combination with a ladder having a pair of longitudinally-extending side rails being transversely spaced apart from one another by a series of rungs extending between and interconnecting said side rails and being longitudinally-spaced apart from one another along said side rails, a ladder leveling apparatus comprising:

(a) a pair of extension members each being disposed adjacent to one of said side rails for slidable movement equally freely in either direction therealong and having opposite ends, one of said opposite ends being disposed along said corresponding side rail and the other of said opposite ends being disposable adjacent a surface on which said ladder will be supported;

(b) a relatively stiff, cable-like semi-flexible elongated member having a middle portion which only makes a single pass across said ladder along a lower one of said ladder rungs and below a portion thereof and opposite end portions which extend in opposite directions from said middle portion and are located along said side rails of said ladder above said one lower rung and attached to said respective extension members at locations between said opposite ends thereof; and (c) means associated with said one lower rung of said ladder and having a portion disposed between said middle portion of said elongated member and said portion of said one lower rung, said means defining at least one surface portion which frictionally engages and crimps said middle portion of said elongated member when the weight of a user is applied to said ladder so as to substantially prevent slippage of said elongated member with respect thereto once said extension members have been placed in contact with the support surface and slidably moved along said side rails of said ladder for positioning and supporting said ladder in a generally leveled upright condition.

2. The combination as recited in claim 1, further comprising:

a pair of brackets attached to each of said side rails of said ladder in spaced apart locations along said extension members such that the latter are guided therebetween in their freely slidable movement along said side rails.

3. The combination as recited in claim 1, wherein each of said extension member has a foot member pivotally mounted to said other opposite end thereof.

4. The combination as recited in claim 1, wherein said surface defining means is a block having an elongated generally axially extending groove formed therein which receives said middle portion of said semi-flexible elongated member in making its single pass across said ladder.

5. The combination as recited in claim 4, wherein said block defines surface portions at opposite ends thereof which frictionally engage said middle portion of said semi-flexible elongated member.

6. The combination as recited in claim 4, wherein said semi-flexible elongated member has a pair of bends formed therein between its middle portion and its opposite end portions adjacent opposite ends of said block.

7. The combination as recited in claim 6, wherein said middle portion of said semi-flexible elongated member is crimped by opposite end corners of said block adjacent said bends in said elongated member.

8. The combination as recited in claim 1, wherein said extension members and said corresponding side rails define respective channels therebetween within which extend said opposite end portions of said semi-flexible elongated member.

9. The combination as recited in claim 8, wherein said semi-flexible elongated member passes only once in a non-looping manner at its middle portion across said ladder through said one lower rung thereof such that in combination with attachment at its end portions to said extension members, said semi-flexible elongated member in effect acts like a sling suspending said ladder thereabove with said sling having upright legs of variable lengths being confined within said channels between said side rails and said extension members.

10. In combination with a ladder having a pair of longitudinally-extending side rails being transversely spaced apart from one another by a series of rungs extending between and interconnecting said side rails and being longitudinally-spaced apart from one another along said side rails, a ladder leveling apparatus comprising:

(a) a pair of extension members each being disposed adjacent to one of said side rails for slidable movement equally freely in either direction therealong and having opposite ends, one of said opposite ends being disposed along said corresponding side rail and the other of said opposite ends being disposable adjacent a surface on which said ladder will be supported;

(b) a relatively stiff, cable-like semi-flexible elongated member having a middle portion which only makes a single pass across said ladder along a lower one of said ladder rungs and below a portion thereof and opposite end portions which extend in opposite directions from said middle portion and are located along said side rails of said ladder above said one lower rung and attached to said respective extension members at locations between said opposite ends thereof; and (c) a block disposed in said one lower rung of said ladder and having an elongated generally axially extending groove formed therein which receives said middle portion of said semi-flexible elongated member in making its single pass across said ladder, said block also having a portion disposed between said middle portion of said elongated member and said portion of said one lower rung, said block portion defining opposite surface portions and corners which frictionally engage and crimp said middle portion of said elongated member when the weight of a user is applied to said ladder so as to substantially prevent slippage of said elongated member with respect thereto once said extension members have been placed in contact with the support surface and slidably moved along said side rails of said ladder for positioning and supporting said ladder in a generally leveled upright condition; and (d) brackets attached to each of said side rails or said ladder in spaced apart locations along said extension members such that the latter are guided therebetween in their freely slidable movement along said side rails.

11. The combination as recited in claim 10, wherein said block defines said surface portions at opposite ends thereof which frictionally engage said middle portion of said semi-flexible elongated member.

12. The combination as recited in claim 11, wherein said semi-flexible elongated member has a pair of bends formed therein between its middle portion and its opposite end portions adjacent opposite ends of said block.

13. The combination as recited in claim 12, wherein said middle portion of said semi-flexible elongated member is crimped by said opposite end corners of said block adjacent said bends in said elongated member.

14. The combination as recited in claim 10, wherein said extension members and said corresponding side rails define respective channels therebetween within which extend said opposite end portions of said semi-flexible elongated member.

15. The combination as recited in claim 14, wherein said semi-flexible elongated member passes only once in a non-looping manner at its middle portion across said ladder through said one lower rung thereof such that in combination with attachment at its end portions to said extension members, said semi-flexible elongated member in effect acts like a sling suspending said ladder thereabove with said sling having upright legs of variable lengths being confined within said channels between said side rails and said extension members.

16. The combination as recited in claim 10, wherein said elongated member is a wire rope.

* * * * *